United States Patent [19]

Hemfort

[11] 3,976,242

[45] Aug. 24, 1976

[54] SELF-EMPTYING CLARIFYING SEPARATOR HAVING A FOAM-FREE REMOVAL OF THE CLARIFIED LIQUID BY MEANS OF A PARING DISK AND AN AUTOMATICALLY OPERATING SYSTEM FOR DETECTING THE LEVEL OF THE SOLIDS IN THE SLUDGE CHAMBER

[75] Inventor: Heinrich Hemfort, Oelde, Germany

[73] Assignee: Westfalia Separator Aktiengesellschaft, Oelde Westfalia, Germany

[22] Filed: July 14, 1975

[21] Appl. No.: 595,928

[30] Foreign Application Priority Data

July 27, 1974 Germany ..... 2436285

[52] U.S. Cl. ..... 233/20 R

[51] Int. Cl.[2] ..... B04B 11/04

[58] Field of Search ..... 233/20 A, 20 R, 19 A, 233/19 R

[56] References Cited

UNITED STATES PATENTS

| | | | |
|---|---|---|---|
| 2,227,837 | 1/1941 | Lindgren | 233/19 A |
| 3,167,509 | 1/1965 | Steinacker | 233/20 R |
| 3,301,476 | 1/1967 | Hemfort | 233/20 R |
| 3,445,061 | 5/1969 | Nilson | 233/20 R |
| 3,593,915 | 7/1971 | Steinacker | 233/20 A |

FOREIGN PATENTS OR APPLICATIONS

| | | | |
|---|---|---|---|
| 1,543,693 | 9/1968 | France | 233/20 A |
| 1,287,517 | 1/1969 | Germany | 233/20 R |

*Primary Examiner*—George H. Krizmanich
*Attorney, Agent, or Firm*—Burgess, Dinklage & Sprung

[57] ABSTRACT

Centrifuge having a self-emptying clarifying drum outfitted with a clarified liquid paring chamber 7 and a clarified liquid paring disc 6. For controlling of emptying of the drum, an auxiliary paring chamber 4 is communicated via a control liquid passageway 9 with the sludge chamber 1. A first auxiliary paring disc 3 is disposed in the auxiliary paring chamber 4, and a second auxiliary paring disc 5, which is smaller in diameter than the first auxiliary paring disc, is disposed in the clarified liquid paring chamber 7. An auxiliary passageway 10, 12 communicates the first and second auxiliary paring discs 3, 5 so that control liquid flows from the auxiliary paring chamber 4, through the auxiliary passageway 10, 12 to the clarified liquid paring chamber 7. A monitoring means 11, 14 is mounted in the auxiliary passageway 10, 12, and is responsive to change in flow through the auxiliary passageway in dependence on sludge accumulation in the sludge chamber and effective to actuate a response means which is operative to effect emptying of the sludge chamber. The flow of control liquid is out from the drum, not circulating, so that sterilization is facilitated. The control liquid passageway 9 is formed as an annular passage defined by a separating plate 23 and the drum cover 24, and a plurality of superimposed insert plates 13 are disposed in the annular passage. The resulting separation in the annular passage improves the sensitivity to sludge accumulation.

2 Claims, 2 Drawing Figures

Figure 1:
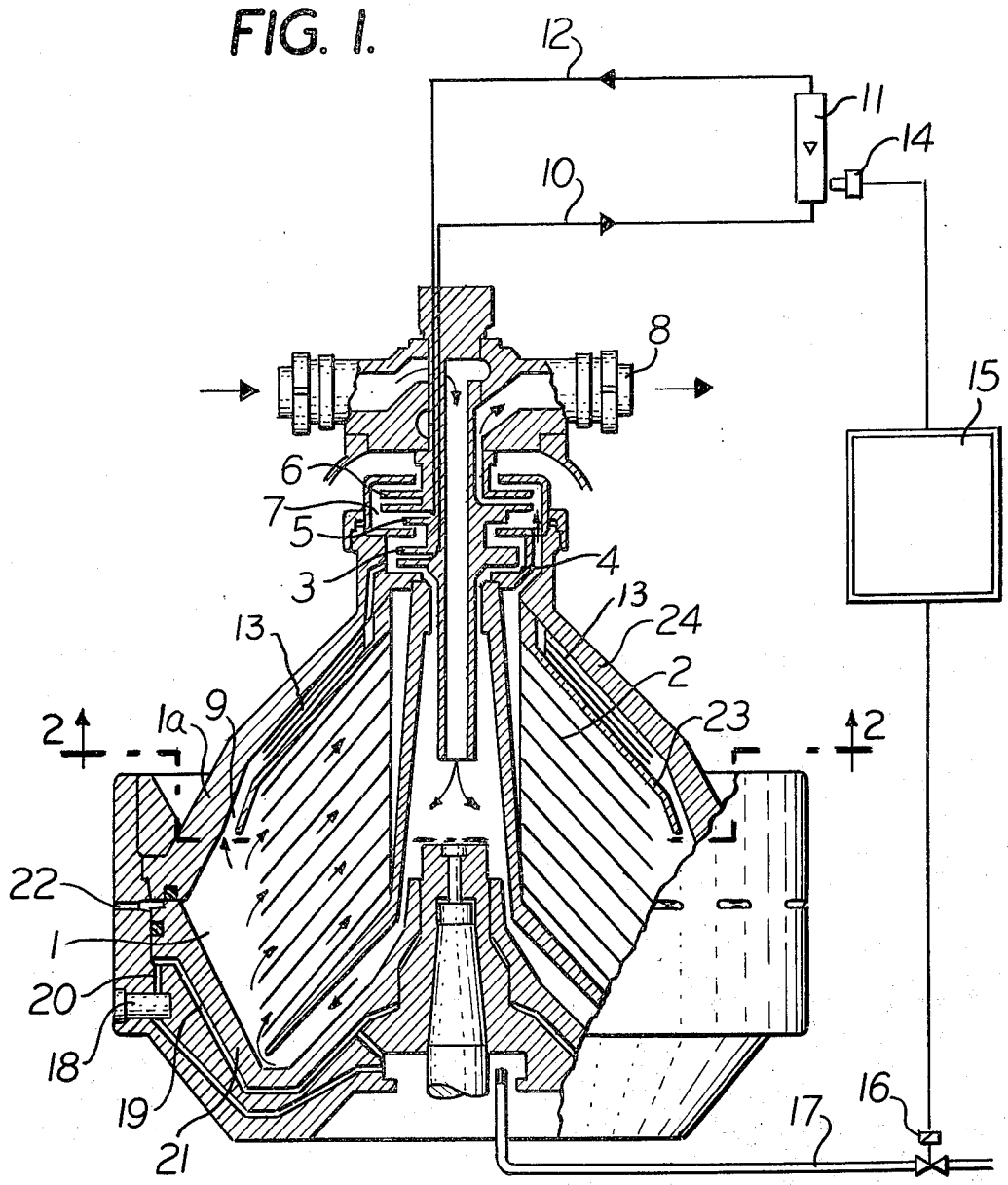

SELF-EMPTYING CLARIFYING SEPARATOR HAVING A FOAM-FREE REMOVAL OF THE CLARIFIED LIQUID BY MEANS OF A PARING DISK AND AN AUTOMATICALLY OPERATING SYSTEM FOR DETECTING THE LEVEL OF THE SOLIDS IN THE SLUDGE CHAMBER

BACKGROUND

The invention relates to a self-emptying clarifying separator with foam-free removal of the clarified liquid by means of a paring disk mounted in a clarified liquid paring chamber, and an automatically operating system for sensing the solid level in the sludge chamber. The separator has one or more passages leading from the sludge chamber to a lower, auxiliary paring chamber, and two auxiliary paring disks of different diameters, the first of which is disposed in the lower, auxiliary paring chamber and the second in the clarified liquid paring chamber. The paring passages of the first and second auxiliary paring disk are communicated with each other by a passageway having mounted therein a flow monitoring means located outside of the separator.

A clarifying separator of this kind is known, for example, from German Gebrauchsmuster No. 7,228,257. In this known separator, the second auxiliary paring disk disposed in the upper, clarified liquid paring chamber has a slightly greater diameter than the first auxiliary paring disk which is disposed in the lower, auxiliary paring chamber. Thus, a small portion of the clarified liquid is pumped by the larger auxiliary paring disk from the upper clarified liquid paring chamber through the flow monitor means located outside of the separator and through the passage from the monitor means to the smaller auxiliary paring disk, into the lower auxiliary paring chamber from which it flows through passages into the sludge chamber of the separator.

These passages are formed partially of bores and partially of segment-shaped chambers separated from one another by ribs. In other designs they consist mostly of individual tubes. As soon as the solids removed by centrifugal force cover the discharge orifices of these passages, the free liquid level in the lower paring chamber shifts inwardly. As a result of the increasing depth of immersion of the first paring disk, which is mounted in the lower paring chamber, the counterpressure acting on the flow monitor is increased, so that the flow diminishes. This decrease of the flow is utilized for the purpose of supplying to a control apparatus the starting pulse for the initiation of the ejection of the solids.

In the known separator, the liquid which senses the level of the solids is introduced into the sludge chamber from the lower paring chamber. As the discharge orifices of the passages begin to be covered by spun-out solids and as the free liquid level in the lower paring chamber begins to shift as a result thereof, the outwardly directed liquid pressure on the discharge orifices of the passages also increases. In the case of fine solids having a tendency to swirl up, the orifices of the passages are flushed repeatedly clear by the increasing liquid pressure, so that a firm plug of solids cannot form. The result is that the system for starting the ejection of the solids does not respond.

When the separator is charged with a cleaning solution, the way the flow operates is the same. Most of the solution is pumped out of the upper paring chamber by the discharge or clarified liquid paring disk, while a small portion is recirculated from the upper paring chamber through the flow monitor and the lower paring chamber into the separator. This is disadvantageous if the liquid that was centrifuged contained bacteria. Complete sterilization can then hardly be achieved on account of the constant recirculation.

Also, it is known, from German Pat. No. 1,145,100, for example, to remove liquid from the sludge chamber for the purpose of sensing the level of the solids, and combine it with the clarified liquid.

THE INVENTION

The invention is addressed to the task of creating an apparatus for sensing the level of solids in a clarifying separator, which will permit the formation of a plug even in the case of solids tending to swirl up, and will allow a virtually complete sterilization to be performed.

The separator of the invention, in summary, is as follows, wherein the reference characters refer to the accompanying drawings, which are described in detail hereinafter. The invention is an improvement in a centrifuge having a self-emptying clarifying drum (1*a*) having a separating plate (23) disposed adjacent the drum cover (24), and a clarified liquid paring chamber (7) and clarified liquid paring disc (6) mounted in the clarified liquid paring chamber for foam-free removal of the clarified liquid. The machine is provided with control means including detecting means for detecting the level of solids in the outer portion of the drum which serves as a sludge chamber (1), and response means operatively connected to the detecting means and operative upon actuation thereof by the detecting means to effect emptying of sludge from the sludge chamber. The detecting means comprising an auxiliary paring chamber (4) formed as part of the drum, a control liquid passageway (9) leading from the sludge chamber to the auxiliary paring chamber (4), first (3) and second (5) auxiliary paring discs which are of different diameter, the first of which is disposed in the auxiliary paring chamber (4) and the second of which is disposed in the clarified liquid paring chamber (7), an auxiliary passageway (10, 12) communicating the first and second auxiliary paring discs and having a monitoring means (11) mounted therein which is responsive to change in flow through the auxiliary passageway (10, 12) in dependence on sludge accumulation in the sludge chamber and effective to actuate the response means. The invention provides the improvement which comprises the first auxiliary paring disc (3) disposed in the auxiliary paring chamber (4) having a larger diameter than the second auxiliary paring disc (5) disposed in the clarified liquid paring chamber (7) for flow of control liquid from the auxiliary paring chamber (4) and through the auxiliary passageway (10, 12) to the clarified liquid paring chamber (7). The control liquid passageway (9) connecting the sludge chamber (1) with the auxiliary paring chamber (4) is constructed substantially as an annular passage (9) which is defined by the separating plate (23) and the drum cover (24). A plurality of superimposed insert plates (13) are disposed in the annular passage (9). Conveniently the clarified liquid paring chamber (7) is disposed above the auxiliary paring chamber (4).

The separator of the invention is characterized in that the first paring disk in the lower paring chamber has a larger diameter than the second paring disk disposed in the upper paring chamber, that the passage connecting the sludge chamber to the lower paring chamber is constructed substantially in the form of an annular passage defined by the separating plate and the cover of the separating drum, and that a plurality of superimposed insert plates are disposed in this annular passage.

Inasmuch as the first paring disk disposed in the lower paring chamber has a larger diameter than the second paring disk, the liquid flows in the reverse direction in the annular passage and in the flow monitor, and the liquid drawn from the sludge chamber is combined in the upper paring chamber with the clarified liquid.

In the case of liquids containing fine solids, however, a portion of the solids is entrained by the flow of the liquid withdrawn from the sludge chamber and these solids recontaminate the clarified liquid. This is prevented in the separator of the invention by the fact that the liquid is clarified in the plate insert disposed in the annular passage. In this manner the formation of the plug in the orifice of the annular channel is favored.

While the solids collecting in the sludge chamber are covering this orifice from without, the solids removed by centrifugation in the plate insert in the annular passage move outwardly and aid in the formation of the plug from within.

The smaller the difference in the diameters of the two paring disks is, the smaller is the amount of liquid flowing through the flow monitor. It can be adjusted to any desired low value.

Another advantage of the separator of the invention lies in the fact that the pressure difference provided by the selected diameters is virtually independent of varying throughputs, because the two paring chambers are communicatingly connected with each other through the separating chamber of the separator, so that the liquid levels in the two chambers change equally as the throughput changes. Lastly, when the separator is charged with cleaning solution a better effect is also achieved, because both streams are running out of the separator.

Figure 2:
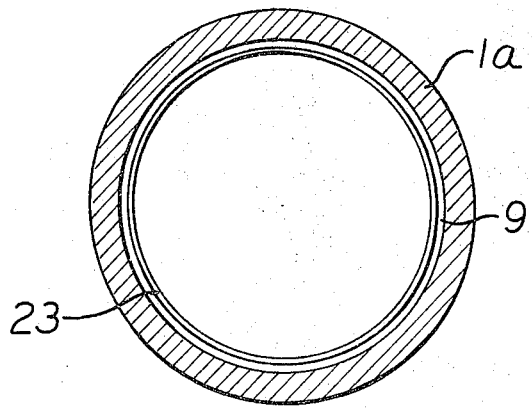

An example of the embodiment of the invention is illustrated in the drawings wherein:

FIG. 1 is an elevation view partially in section of a separator according to the invention; and FIG. 2 is horizontal partial cross section taken along line 2—2 in FIG. 1.

The solids chamber of drum 1*a*, outside of the plate insert 2 is marked 1. The paring disk 3 in the lower paring chamber 4 has a slightly larger diameter than the paring disk 5, which is disposed in the upper paring chamber 7 in addition to the paring disk 6 which carries away the clarified liquid. The paring disk 6 has the largest diameter. The liquid levels, which are at the same distance from the axis of rotation in both of the paring chambers 4 and 7 on account of the communicating connection between them, are adjusted by means of a throttling member, which is not shown, in the discharge line 8, so that the paring disks 3 and 5 are also immersed in the liquid.

During operation, the first paring disk 3 draws a small amount of liquid from the sludge chamber 1 through the annular passage 9 and propels it through line 10, flow monitor 11, line 12, and the paring disk 5, into the upper paring chamber 7 from which it is carried together with the clarified liquid by means of paring disk 6. A plurality of insert plates 13 are disposed in annular passage 9 and clarify the liquid drawn from the sludge chamber 1. The separated solids move outwardly.

When the ring of solids in sludge chamber 1 reaches the intake orifice of the annular passage 9, the solids which are spun out in plates 13 aid in the formation of a plug. As the flow diminishes, the flow monitor 11 delivers a starting pulse by means of a pulse generator 14 to a control apparatus 15. The valve 16 in the control water feed line 17 is shut, whereupon the outlet valve 18 opens and discharges the liquid, filling the closing chamber 19, through the passage 20. The piston 21 moves downwardly under the pressure of the drum charge and the solids are ejected through the ejection slits 22.

At the end of the time preset at the control apparatus 15, valve 16 is reopened, the outlet valve 18 closes, the closing chamber 19 fills up again, and the piston 21 moves back into the closed position.

The annular passage 9 is defined by separating plate 23 and drum cover 24.

What is claimed is:

1. In a centrifuge having a self-emptying clarifying drum having a separating plate disposed adjacent the drum cover, and a clarified liquid paring chamber and clarified liquid paring disc mounted in the clarified liquid paring chamber for foam-free removal of the clarified liquid, and control means including detecting means for detecting the level of solids in the outer portion of the drum which serves as a sludge chamber, and response means operatively connected to the detecting means and operative upon actuation thereof by the detecting means to effect emptying of sludge from the sludge chamber, said detecting means comprising an auxiliary paring chamber formed as part of the drum, a control liquid passageway leading from the sludge chamber to the auxiliary paring chamber, first and second auxiliary paring discs which are of different diameter, the first of which is disposed in the auxiliary paring chamber and the second of which is disposed in the clarified liquid paring chamber, an auxiliary passageway communicating the first and second auxiliary paring discs and having a monitoring means mounted therein which is responsive to change in flow through the auxiliary passageway in dependence on sludge accumulation in the sludge chamber and effective to actuate the response means, the improvement which comprises the first auxiliary paring disc disposed in the auxiliary paring chamber having a larger diameter than the second auxiliary paring disc disposed in the clarified liquid paring chamber for flow of control liquid from the auxiliary paring chamber and through the auxiliary passageway to the clarified liquid paring chamber, the control liquid passageway connecting the sludge chamber with the auxiliary paring chamber being constructed substantially as an annular passage which is defined by said separating plate and the drum cover, and a plurality of superimposed insert plates disposed in the annular passage.

2. Centrifuge according to claim 1, wherein the clarified liquid paring chamber is disposed above the auxiliary paring chamber.

* * * * *